United States Patent [19]

Lapointe

[11] 4,351,399

[45] Sep. 28, 1982

[54] DRILL

[75] Inventor: Roland R. Lapointe, Claremont, N.H.

[73] Assignee: Joy Manufacturing Company, Pittsburgh, Pa.

[21] Appl. No.: 166,264

[22] Filed: Jul. 3, 1980

[51] Int. Cl.[3] ..... B23Q 5/00; E21C 5/00; B23Q 5/027; B23Q 5/033

[52] U.S. Cl. ..... 173/148; 175/220; 308/4 A

[58] Field of Search ..... 173/148, 165; 175/220; 308/4 A, 3.9

[56] References Cited

U.S. PATENT DOCUMENTS

| | | | |
|---|---|---|---|
| 1,883,070 | 10/1932 | Stone | 173/148 X |
| 2,334,312 | 11/1943 | Caldwell | 255/22 |
| 2,472,999 | 6/1949 | Alexander et al. | 255/22 |
| 3,282,356 | 11/1966 | Paulson et al. | 308/4 A |
| 3,302,983 | 2/1967 | Garrett | 308/4 A |
| 3,561,545 | 2/1971 | Rassieur | 173/166 |
| 3,730,285 | 5/1973 | Anderson et al. | 175/220 |
| 3,933,203 | 1/1976 | Evans | 308/4 A |
| 3,949,818 | 4/1976 | Russell | 175/52 |

*Primary Examiner*—Ronald Feldbaum
*Attorney, Agent, or Firm*—Raymond W. Augustin

[57] ABSTRACT

An earth drilling apparatus including centralizer means for stabilizing a drive rod during drilling operations.

23 Claims, 5 Drawing Figures

DRILL

In the art of earth drilling such as wire line core drilling operations it is well known to utilize a drilling apparatus which includes a rotary drive means to rotate an elongate kelly or drive rod which is axially slidable with respect to the rotary drive. Typically, one or more feed devices such as fluid powered feed cylinders are provided to operate in conjunction with the rotary drive to exert a down-bearing force or thrust on the drive rod whereby a rotary, down-bearing drilling action may be imparted to a drilling implement such as an auger or a core barrel assembly affixed to the lower end of the drive rod. Drilling apparatus of the type specified has been especially well suited to core drilling and other drilling operations in which the parameters of rotary drilling speed and drilling force or down pressure must be carefully controlled.

Such drills are described in U.S. Pat. Nos. 1,883,070; 2,472,999; 3,949,818; 3,561,545 and 2,334,312, for example.

The present invention relates to improved centralizer means for stabilizing a drive rod in a drilling apparatus of the above-described type and has a general objective to provide an improved earth drilling apparatus.

Another object of the invention is to provide a drilling apparatus of the type described with improved drive rod stability to thereby improve controlability of drilling operations.

Another object of the invention is to provide centralizer means for a drive rod in a drilling apparatus.

A further object of the invention is to provide a movable stabilizer or centralizer means which moves axially in conjunction with axial movement of the drive rod during drilling operations.

These and other objects and advantages of the invention will be more clearly understood upon consideration of the following description with reference to the accompanying figures, in which.

Figure 1:
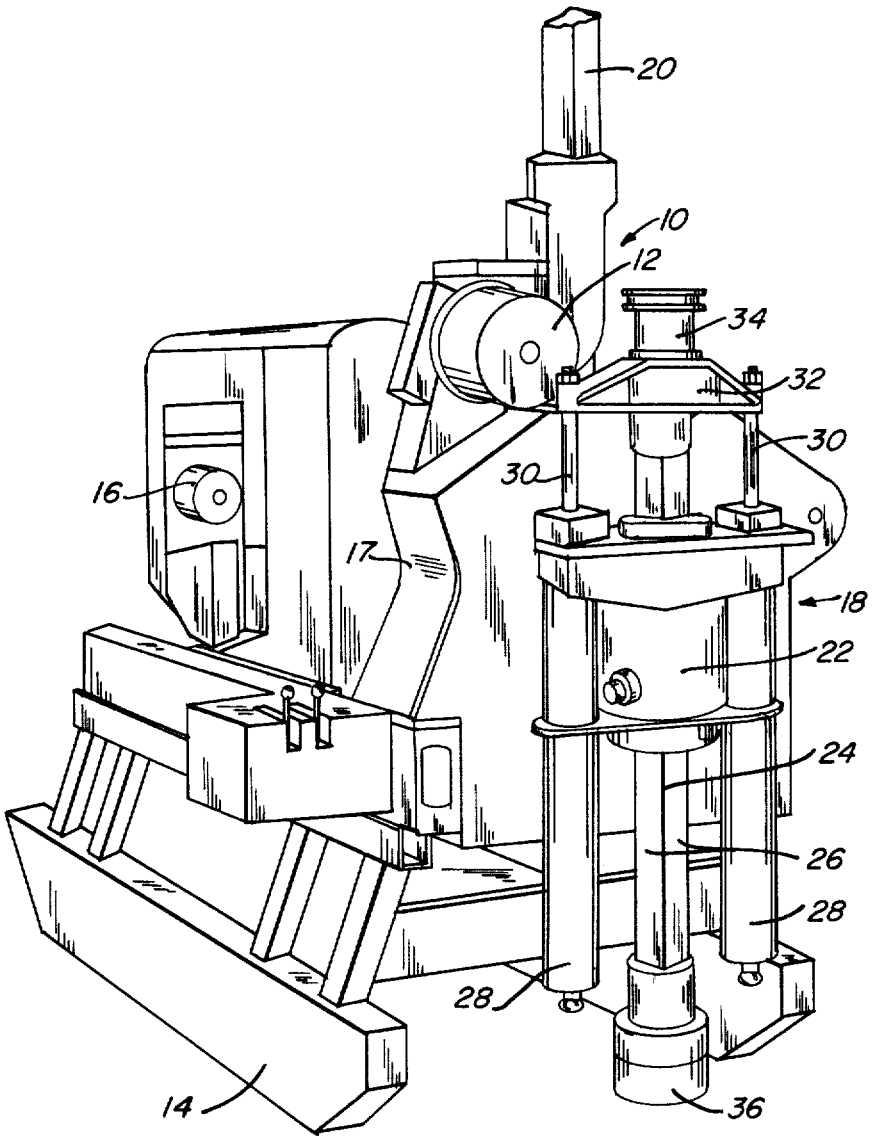
FIG. 1 (PRIOR ART)
FIG. 1 is a perspective view of a drive rod type drilling apparatus generally of the prior art type.

Referring to FIG. 1, there is shown a drilling apparatus generally indicated at 10 and of a type known in the prior art to include a drilling rig 12 which may be mounted on any suitable base such as skids 14. Drilling rig 12 includes motive power means such as a deisel engine 16 and any suitable mechanical transmission means 17 for powering a rotary drive head portion 22 of a drive assembly 18 carried by drilling rig 12. As is well known, drilling rig 12 typically will include an upstanding mast 20, a suitable hoist (not shown) and other necessities such as a length of wire rope or cable (not shown) which is reeved on the hoist drum and passed over pulleys or through a block (not shown) carried adjacent the upper end of mast 20 as is typical for known wire line core drilling apparatus.

Drive assembly 18 commonly includes, in addition to rotary drive head 22, an elongated drive rod 24 which is axially slidable with respect to drive head 22 and is maintained in rotary driving engagement therewith by drive surfaces such as axially extending flats 26 formed on the periphery of drive rod 24. Drive assembly 18 also includes a feed means such as a pair of double acting hydraulic feed cylinders 28 carried rigidly with respect to drive head 22 at locations spaced laterally from drive rod 24 and extending axially of drive rod 24. Cylinders 28 include selectively upwardly extensible piston rod portions 30 the upper ends of which are secured to a yoke 32 for selectively moving yoke 32 axially with respect to drive head 22. Yoke 32 includes a rotary thrust bearing 34 which receives the upper or rearward axial end of drive rod 24 whereby feed cylinders 28 are selectively operable by suitable fluid power means (not shown) to selectively exert an axially directed, down-bearing force on drive rod 24 concurrently with powered axial rotation thereof by drive head 22 for drilling operations, or to lift drive rod 24 upwardly from the formation being drilled. A securing device such as a chuck 36 is carried by drive rod 24 adjacent the lower or forwardmost end thereof for securing thereto a drilling implement (not shown) such as a core barrel assembly or an auger bit whereby such drilling implement may be driven in a conventional, down-bearing rotary drilling mode. Inasmuch as the apparatus described hereinabove is well known to those versed in the art and forms no part of the instant invention, further detailed description thereof is believed to be unnecessary.

Figure 2:
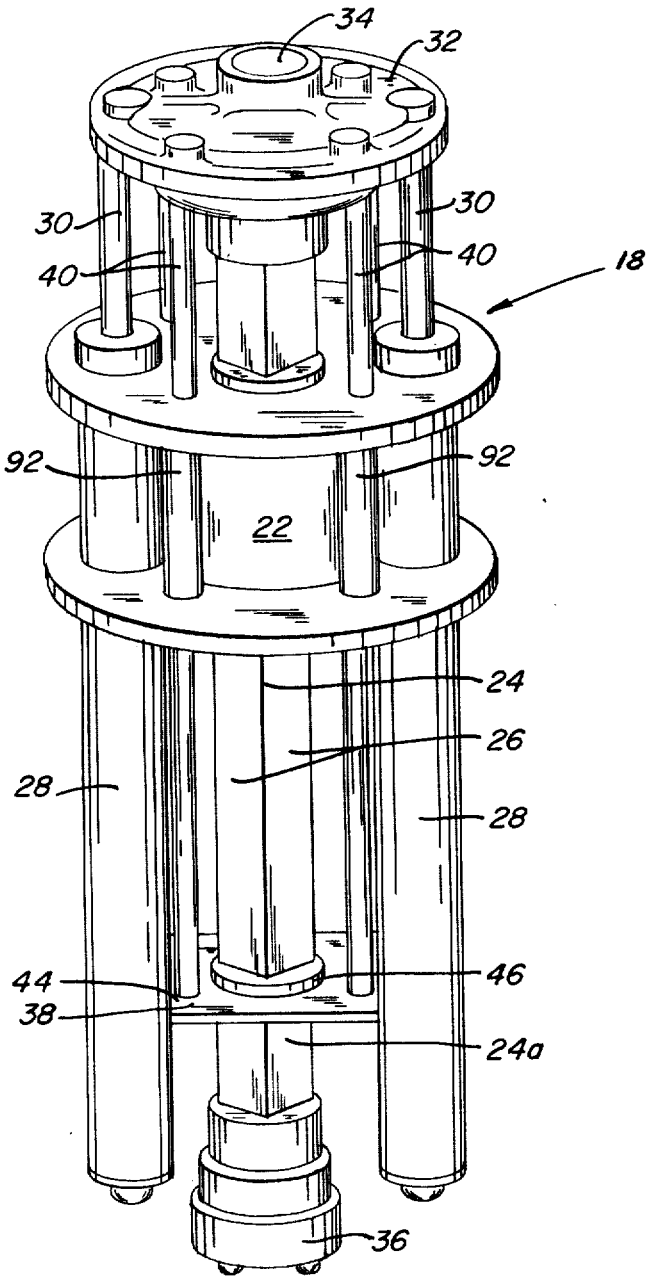
FIG. 2 is a simplified perspective view of a drive assembly portion of a drilling apparatus similar to that shown in FIG. 1 and incorporating a presently preferred embodiment of the instant invention.

Referring now to FIG. 2, there is shown a drive assembly 18 similar in many respects to that illustrated in FIG. 1 and including a rotary drive head 22, a drive rod 24, a pair of feed cylinders 28, a yoke 32 and a chuck 36 assembled and operable substantially as described hereinabove with reference to FIG. 1. Drive assembly 18 of FIG. 2 also includes a centralizer assembly 38 for stabilizing drive rod 24 during drilling operations. Centralizer assembly 38 includes elongated guide rods 40 rigidly affixed to yoke 32 and extending downwardly or forwardly therefrom to axially coextend with a major part of the length of drive rod 24. Guide rods 40 pass through guide portions 92 of drive head 22 and are preferably plural in number, there being shown in FIG. 2 four guide rods 40 spaced circumferentially about drive rod 24 and equidistant therefrom although in practice fewer or more guide rods 40 may be employed at either uniform or varying spacing with respect to each other and with respect to their radial distance from drive rod 24.

Guide rods 40 thus extend forwardly or downwardly of drive head 22 generally parallel to drive rod 24. A centralizer means 44 is rigidly secured adjacent the forward ends of guide rods 40 and encompass drive rod 24 adjacent a drive rod forward end portion **24*a* to stabilize drive rod 24 during drilling operations. Centralizer 44 includes a rotary bearing portion 46 which receives drive flats 26 of drive rod 24 whereby drive rod 24 is axially rotatable with respect to centralizer 44** while being laterally stabilized thereby.

Figure 3:
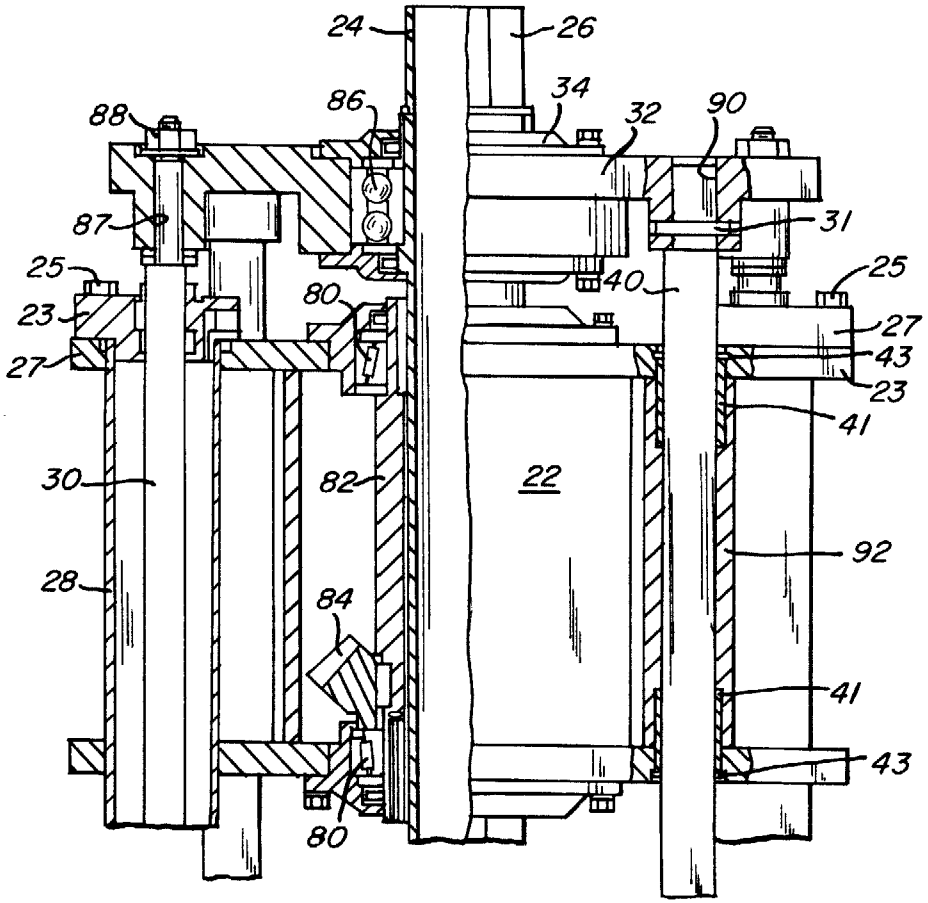
FIG. 3 is a fragmentary side elevation of the drive assembly of FIG. 2 shown partially in section.

Referring now to FIG. 3, rotary drive head 22 as shown includes a housing 23 within which is supported an arrangement of upper and lower rotary support bearings 80 which, in turn, support an elongated, hollow drive sleeve 82 shown as having a bevel gear 84 coaxially and nonrotatably secured thereto for driving of sleeve 82 by engine 16 through transmission 17 in the conventional manner. Drive rod 24 is adapted to slide coaxially within sleeve 82 and flats 26 on drive rod 24 are adapted to mate with cooperating flats (not shown) formed within sleeve 82 whereby, when drive rod 24 is being rotatably driven by drive head 22 it is also axially slidable with respect thereto. The upper end of drive rod 24 is supported with respect to yoke 32 by thrust bearing means 34 carried by yoke 32 and shown in FIG. 3 as including a rotary ball thrust bearing assembly 86.

Also shown in FIG. 3 are feed cylinders 28 which are rigidly carried with respect to drive head 22 as by having upper collar portions 23 rigidly bolted by bolts 25 to an upper, laterally extending plate portion 27 of drive head 22. Cylinders 28 are located such that the respective piston rods 30 are axially aligned with through bores 87 formed in yoke 32 and the ends of piston rods 30 are received within bores 87 and rigidly secured to yoke 32 by any suitable means such as cooperating nuts 88 which engage threaded end portions of the piston rods 30. The upper end of each guide rod 40 is secured in any suitable manner within a cooperating bore 90 formed in yoke 32 such as by pins 31 secured by interference fit within aligned cross bores in the conventional manner. The upper ends of rods 40 may be secured to yoke 32 by any suitable alternative means as by having threads (not shown) formed thereon for engagement within cooperating tapped bores (not shown) formed in yoke 32. Each of rods 40 extends downwardly from yoke 32 through the respective elongated guide portion 92 of drive head 22. Each guide portion 92 includes upper and lower elongated annular guide bushings 41 for guiding the respective rod 40 and respective annular seal members 43 for sealing against entry of foreign matter such as dust into the guide portion 92. Accordingly, guide rods 40 are axially slidable with respect to drive head 22 and are laterally supported with respect thereto by the guide portions 92.

In the embodiment of FIGS. 2 and 3 as described above, centralizer 38 provides lateral reaction elements to resist lateral displacement of the drive rod end portion 24*a*. The reaction forces are provided primarily by the bending strength of guide rods 40 and by rotary drive head 22. Thus, only insignificant lateral forces are imposed upon yoke 32 by the guide rods 40. The resulting side bending loads on piston rods 30 are therefore inconsequential, and the possibility that a piston rod 30 may be damaged through bending is thus minimized. It will be further appreciated that inasmuch as guide rods 40 are affixed to yoke 32 and movable therewith as is drive rod 24, centralizer member 44 which is affixed to the guide rods 40 moves upwardly and downwardly with drive rod 24 and is axially stationary with respect thereto. Accordingly, for any axial position of drive rod 24, forward end portion 24*a* thereof is laterally supported with respect to drive head 22 by centralizer assembly 38. More importantly, drive rod 24 is stabilized by centralizer member 44 at a point progressively further from drive head 22 throughout the downward or forward stroke of the drive rod. This provides important benefits over stationary centralizers which have no capability for uniform continuous support of a specific portion of a movable drive rod. For example, during drilling the length of drive rod 24 forward of drive head 22 is under considerable axial compression and torsion due to the drilling forces imposed thereon. Therefore, as drilling progresses and the drive rod moves forward (downward) in its stroke, the length of the drive rod portion extending forwardly of drive head 22 increases and lateral support of drive rod forward end 24*a* becomes increasingly necessary. This beneficial lateral support is achieved the manner in which centralizer 44 moves in conjunction with movement of drive rod 24.

Figure 4:
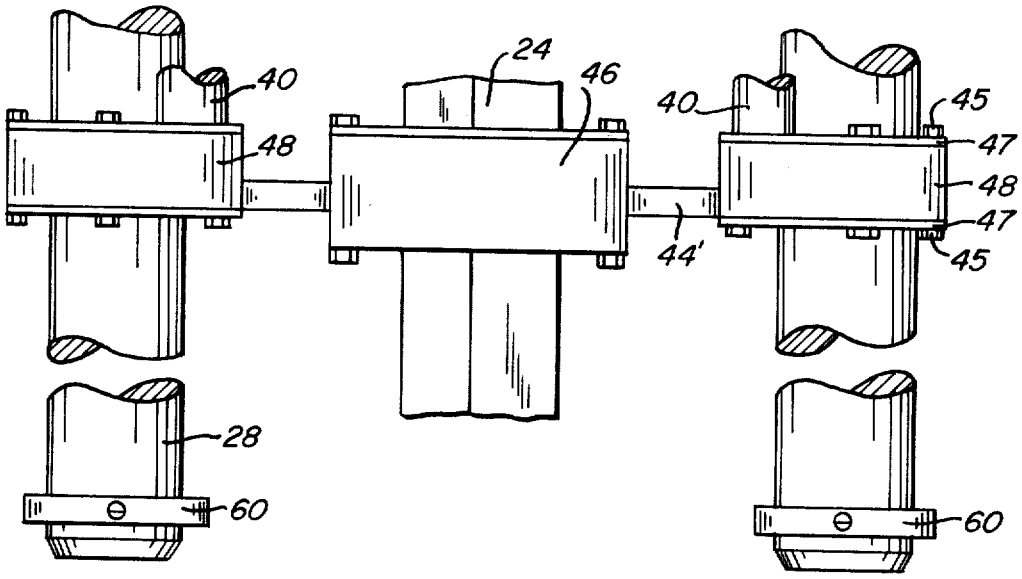
FIG. 4 is a fragmentary side elevation of a portion of a drive assembly similar to that of FIG. 2 and showing another presently preferred embodiment of the invention.
Figure 5:
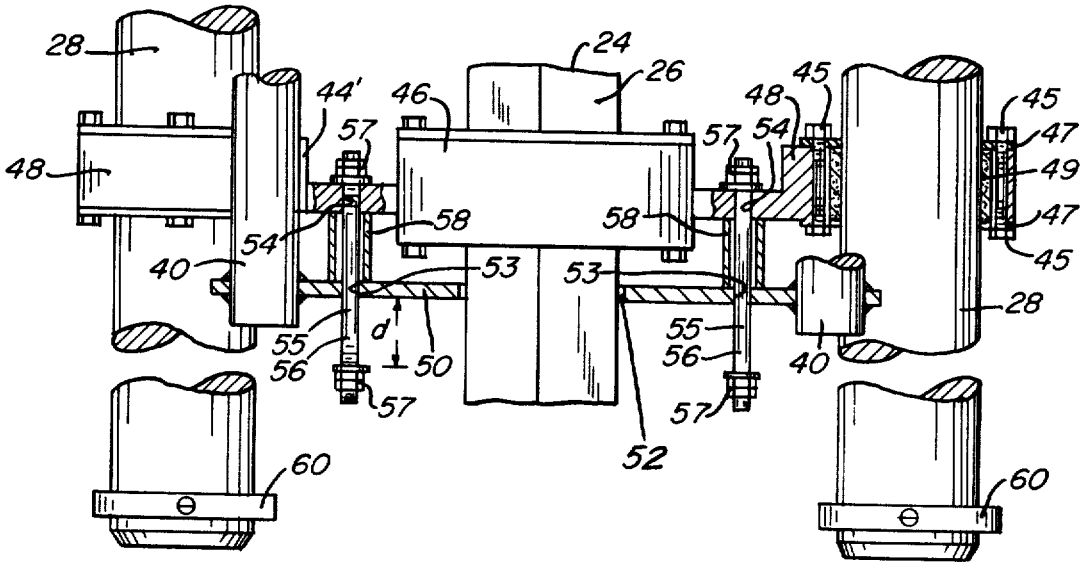
FIG. 5 is a side elevation similar to FIG. 4 and partially in section showing yet another presently preferred embodiment of the invention.

Referring to FIGS. 4 and 5, there are shown other preferred embodiments of the invention similar in many respects to the above described embodiments, in which drive rod 24 passes through a rotary bearing portion 46 of a centralizer 44' mounted adjacent the lower ends of plural guide rods 40. Centralizer 44' additionally includes laterally outwardly projecting support portions 48, each of which snugly and slideably encompasses the lower extent of one of feed cylinders 28 so as to be slidable thereon. The sectioned portion of FIG. 5 shows details of the sliding engagement of support portion 48 on cylinder 28 as including an annular bushing 49 encompassing cylinder 28 and captively retained with respect to support portion 48 as by annular face plates 47 secured to portion 48 by bolts 45. Drive rod 24 is thus laterally stabilized with respect to drive head 22 by the rigidity of feed cylinders 28 which are rigidly located with respect to drive head 22, and is also stabilized by guide rods 40 in the manner hereinabove described.

There is shown in FIG. 5 a modification of the embodiment of FIG. 4, in which drive rod 24 passes through a rotary bearing portion 46 of a centralizer member 44' which includes laterally projecting support portions 48 snugly and slideably encompassing feed cylinders 28 to stabilize drive rod 24 with respect to drive head 22 as described hereinabove with reference to FIG. 4. In this embodiment, as in the others hereinabove described, guide rods 40 are provided, these being rigidly affixed to yoke 32 as in FIG. 3 and extending axially of drive rod 24. In this case, however, guide rods 40 have rigidly secured adjacent the lower ends thereof a guide plate 50 which includes an aperture 52 such that plate 50 encompasses but does not contact drive rod 24. Plate 50 and centralizer 44' are provided with a plurality of axially aligned through-bore pairs 53, 54 through which there extend a respective plurality of nut and bolt assemblies 56 of uniform length. Each assembly 56 includes a bolt 55 and each is adjustable by adjustment of nuts 57 threaded onto the axial ends thereof to define a predetermined maximum axial spacing between plate 50 and centralizer 44'. A sleeve 58 encompasses each of the bolts 55 intermediate plate 50 and centralizer 44' and the axial length of the sleeves 58 defines a minimum spacing less than the predetermined maximum spacing therebetween. The difference "d" (FIG. 5) between this minimum and maximum spacing defines a predeterminable, limited freeplay or lost motion capability between centralizer 44' and plate 50.

As centralizer 44' is not loosely slidable upon feed cylinders 28, it will naturally tend to maintain its axial position with respect thereto as drive rod 24 is moved axially upon actuation of the feed cylinders 28. Thus, during drilling operations when piston rods 30 of feed cylinders 28 are retracted from their fully extended position to drive the drive rod 24 downwardly, guide rods 40 and plate 50 will move downwardly to the limit permitted by the freeplay or lost motion in bolt assemblies 56 at which point further movement of guide rods 40 and plate 50 will pull centralizer 44' along to provide lateral stabilization for drive rod end portion 24*a* as drilling progresses and it moves progressively further from the drive head 22.

During the drive rod retraction stroke, extension of piston rods 30 results in upward movement of yoke 32, guide rods 40, plate 50 and sleeves 58 until the sleeves 58 engage centralizer 44' to push the centralizer 44' upward ahead of plate 50 throughout the remainder of the drive rod retraction stroke. It will be seen that in this embodiment of the invention the described lost motion capability permits a longer stroke of drive rod 24 than would otherwise be possible as support extensions 48 of centralizer 44' limit the axially downward movement of centralizer 44 according to the placement of suitable stops 60 affixed rigidly adjacent the lower ends of the feed cylinders 28. Thus, the described lost motion capability between movement of plate 50 and centralizer 44' permits a longer stroke of drive rod 24 than would be otherwise available, and to the extent that the magnitude of the lost motion (d) can be increased by advantageous selection of bolt and sleeve lengths, the stroke of drive rod 24 can be correspondingly increased. It is to be appreciated that the lost motion capability as shown in FIG. 5 may be advantageously utilized in conjunction with any of the other described embodiments of the invention.

In view of the above description the operation of the present invention will be apparent in that the traveling stabilizer provides a stabilizing or centralizing effect on a forward end portion of a drive rod as such forward end portion progresses further from a drive head during the drive rod drilling stroke. The centralizer functions to laterally stabilize the drive rod with respect to the drive head through one or more of several direct mechanical connections as shown in FIG. 2 (sliding engagement of guide rods within portions of the drive head for consequent support of a centralizer member which stabilizes the drive rod) and in FIG. 4 (sliding engagement of a centralizer member directly on feed cylinder tubes which are rigidly carried by or with respect to drive head 22). Also, in each case the described centralizer member is movable axially with a forward end portion of the drive rod during drilling operations by direct connection of the centralizer member to a traveling yoke through the guide rods or by virtue of such a connection combined with a lost motion capability. The lost motion capability permits limited axial movement of the drive rod with respect to the centralizer member within a predetermined range of movement.

According to the description hereinabove there is provided by the present invention a beneficially improved drive rod drilling apparatus including novel centralizer improvements as described. Notwithstanding the description hereinabove of certain preferred embodiments of the invention, it is to be appreciated that various alternate embodiments and modifications are contemplated by applicant to be within the scope of the invention. For example, the apparatus may be applied to modes of drilling other than wire line core drilling, such as auger drilling for example; the feed devices need not be hydraulic cylinders nor need they be fluid operated devices at all; the support portions of the rotary drive head which support the guide rods may be a support means independent of the rotary drive head; and the like.

These and other embodiments and modifications having been envisioned and anticipated by the inventor, this invention should be interpreted as broadly as permitted by the scope of the claims appended hereto.

What is claimed is:

1. In an earth drilling apparatus wherein an elongated drive rod is movable in the direction of the axial extent thereof and is adapted to carry an implement adjacent a first end of a forward end portion for earth boring and wherein said drive rod is cooperable with a feed portion of said drilling apparatus and with a rotary drive means in that said feed portion includes feed means operable to move said drive rod in such axial direction with respect to said rotary drive means and said rotary drive means is operable to drive said drive rod in axial rotation, the improvement comprising:

centralizer means adjacent a second end of said forward end portion and slidably cooperable with said forward end portion of said drive rod and capable of axial movement in conjunction therewith for stabilizing said forward end portion of said drive rod during such earth boring.

2. The improvement as claimed in claim 1 wherein said centralizer means is cooperable with said feed portion for axial movement of said centralizer in conjunction with axial movement of said drive rod by said feed means.

3. The improvement as claimed in claim 2 wherein said centralizer means is connected to said feed portion in a manner that said feed means is operable to impart concomitant axial motion to said drive rod and said centralizer means.

4. The improvement as claimed in claim 3 wherein said centralizer means includes a centralizing member located adjacent said forward end portion of said drive rod and includes elongated means extending intermediate said centralizing member and said feed means for connecting said centralizing member to said feed portion for such concomitant axial motion.

5. The improvement as claimed in claim 4 wherein said centralizing member engages said drive rod for lateral support thereof by said centralizer means with respect to said rotary drive means.

6. The improvement as claimed in claim 5 wherein said lateral support is continuous lateral support of said drive rod with respect to said rotary drive means.

7. The improvement as claimed in claim 5 wherein said elongated means extends axially of said drive rod intermediate said centralizing member and said feed means and is laterally supported by and axially movable with respect to said rotary drive means.

8. The improvement as claimed in claim 7 wherein said rotary drive means includes support means integral therewith for such lateral support of said elongated means.

9. The improvement as claimed in claim 3 including stationary means fixedly located with respect to said rotary drive means and extending axially of said drive rod wherein said centralizer means is cooperable with said stationary means for lateral support of said drive rod adjacent said forward end thereof.

10. The improvement as claimed in claim 9 wherein said centralizer means includes a centralizing assembly located adjacent said forward end portion of said drive rod and includes elongated means extending axially of said drive rod intermediate said centralizing assembly and said feed means for connecting said centralizing assembly to said feed means for such concomitant axial motion.

11. The improvement as claimed in claim 10 wherein said centralizing assembly includes lateral support means cooperable with said drive rod and said stationary means for such lateral support of said drive rod adjacent said forward end thereof.

12. The improvement as claimed in claim 11 wherein said centralizing assembly includes a first guide means including said lateral support means and a second guide means carried by said elongated means, and lost motion connecting means for providing an axial lost motion connection between said first and second guide means.

13. The improvement as claimed in claim 12 wherein said stationary means is an integral part of said feed portion.

14. In an earth drilling apparatus including an elongated drive rod adapted to carry an implement adjacent a first end of a forward end portion thereof for earth drilling or the like wherein a feed means associated with a feed portion of said drilling apparatus engages a second portion of said drive rod spaced axially from said forward end portion thereof and a rotary drive means engages said drive rod longitudinally intermediate said forward end portion and said second portion thereof and wherein said feed means is selectively operable to move said drive rod axially with respect to said rotary drive means for such earth drilling and said rotary drive means is selectively operable to impart axial rotation to said drive rod for such earth drilling, the improvement comprising:

centralizer means slidably engageable with said drive rod adjacent a second end of said forward end portion for support of said drive rod with respect to said rotary drive means and said centralizer means being cooperable with said feed portion and capable of axial movement in conjunction therewith to maintain such support throughout such axial movement of said drive rod.

15. The improvement as claimed in claim 14 wherein said feed means is operable to provide concomitant axial motion of said centralizer means and said drive rod with respect to said rotary drive means.

16. The improvement as claimed in claim 15 wherein said rotary drive means includes support means cooperable with said centralizer means for providing lateral support of said drive rod with respect to said rotary drive means.

17. The improvement as claimed in claim 14 wherein said feed portion includes elongated means fixedly located with respect to said rotary drive means and said centralizer means includes lateral support means cooperable with said elongated means to maintain such lateral support of said drive rod with respect to said rotary drive means.

18. The improvement as claimed in claim 15 wherein said centralizer means includes lost motion means for permitting the portion of said centralizer means which supports said drive rod a limited degree of axial movement with respect to said drive rod.

19. In an earth drilling apparatus, the combination comprising:

an elongated drive rod adapted to carry a drilling implement adjacent one end of a foward end portion thereof;

a feed means engageable with a first portion of said drive rod spaced axially from said one axial end thereof and adapted to impart linear motion to said drive rod in the direction of the axial extent thereof;

rotary drive means engageable with a second portion of said drive rod axially intemediate said one axial end and said first portion thereof and adapted to impart axial rotation to said drive rod;

said drive rod being axially movable with respect to said rotary drive means in a manner to permit said feed means and said rotary drive means to simultaneously impart, respectively, such linear axial motion and such axial rotation to said drive rod;

and centralizer means adjacent a second end of said forward end portion and cooperable with said feed means and said rotary drive means and slidably engageable with said forward end portion of said drive rod and capable of axial movement in conjunction therewith to provide continuous lateral support for said drive rod throughout such linear axial motion and such axial rotation thereof.

20. In an earth drilling apparatus wherein an elongated drive rod is movable in the direction of the axial extent thereof and is adapted to carry an implement adjacent a first end of a forward end portion thereof for earth boring and wherein said drive rod is cooperable with a feed portion of said drilling apparatus, said feed portion includes feed means operable to move said drive rod in such axial direction, the improvement comprising:

a centralizer means adjacent a second end of said forward end portion, said centralizer in sliding axial contact with said drive rod, said centralizer means capable of laterally supporting said drive rod and capable of axial movement in conjunction with said forward end portion of said drive rod during such earth boring.

21. The improvement as claimed in claim 20 wherein said centralizer means is cooperable with said feed portion for axial movement of said centralizer in conjunction with axial movement of said drive rod by said feed means.

22. The improvement as claimed in claim 21 wherein said centralizer means is connected to said feed portion in a manner that said feed means is operable to impart concomitant axial motion to said drive rod and said centralizer means.

23. The improvement as claimed in claim 22 wherein said centralizer means includes a centralizer member located adjacent said forward end portion of said drive rod and includes elongated means extending intermediate said centralizer member and said feed means for connecting said centralizing member to said feed portion for such concomitant axial motion.

* * * * *